US005579553A

United States Patent [19]

Holley

[11] Patent Number: 5,579,553

[45] Date of Patent: Dec. 3, 1996

[54] BALLAST BROOM WITH AUGER AND METHOD

[75] Inventor: John D. Holley, Montgomery, Ala.

[73] Assignee: Holley Engineering Company, Inc., Montgomery, Ala.

[21] Appl. No.: 503,207

[22] Filed: Jul. 17, 1995

[51] Int. Cl.[6] ..... B61F 19/00

[52] U.S. Cl. ..... 15/55; 15/83; 15/340.3; 104/279

[58] Field of Search ..... 15/54, 55, 82, 15/83, 340.3; 104/2, 279; 134/6, 21; 198/668–672, 311, 677

[56] References Cited

U.S. PATENT DOCUMENTS

| | | | |
|---|---|---|---|
| Re. 31,619 | 7/1984 | Holley . | |
| 2,505,501 | 4/1950 | Miller et al. | 104/279 |
| 2,594,116 | 4/1952 | Beyer et al. | 15/83 |
| 2,869,159 | 1/1959 | Kershaw | 15/55 |
| 3,005,274 | 10/1961 | Kershaw . | |
| 3,034,236 | 5/1962 | Pyke | 104/279 |
| 3,277,511 | 10/1966 | Little et al. | 15/340.3 |
| 3,337,026 | 8/1967 | Silver et al. | 198/670 |
| 3,719,966 | 3/1973 | Lamont . | |
| 3,886,675 | 6/1975 | Maisonneuve et al. | 15/54 |
| 4,007,026 | 2/1977 | Groh . | |
| 4,110,864 | 9/1978 | Gunnarsson . | |
| 4,117,920 | 10/1978 | Oury | 198/311 |
| 4,200,953 | 5/1980 | Overton . | |
| 4,285,737 | 8/1981 | Price . | |
| 4,650,504 | 3/1987 | Howeth . | |
| 4,708,723 | 11/1987 | Howeth . | |
| 4,741,072 | 5/1988 | Wilkerson | 15/340.3 |
| 4,756,727 | 7/1988 | Howeth . | |
| 4,773,121 | 9/1988 | Young . | |
| 4,802,983 | 2/1989 | Howeth . | |
| 5,172,638 | 12/1992 | Mathison et al. . | |
| 5,303,448 | 4/1994 | Hennessey et al. . | |
| 5,394,586 | 3/1995 | Holley . | |

FOREIGN PATENT DOCUMENTS

| | | | |
|---|---|---|---|
| 418428 | 3/1991 | European Pat. Off. | 104/2 |
| 1121101 | 1/1955 | Germany | 15/83 |

*Primary Examiner*—David Scherbel
*Assistant Examiner*—Terrence R. Till
*Attorney, Agent, or Firm*—William L. Feeney; Kerkam, Stowell, Kondracki & Clarke, P.C.

[57] ABSTRACT

A railroad ballast broom vehicle uses a double or split auger to move ballast received from a rotary core broom. The auger has various features to minimize the risk of it jamming on ballast which it moves to the field side of rails of the railroad bed which is being swept. Flex plates are used to mount broom drive hydraulic motors to minimize or avoid problems which might otherwise be caused by slight misalignments in the motors and the rotary core of the broom. A dust control system is used to minimize escape of dust from operation of the vehicle. A method of using the vehicle advantageously uses only a single pass of the vehicle over a given section of road bed in need of sweeping.

20 Claims, 6 Drawing Sheets

BALLAST BROOM WITH AUGER AND METHOD

BACKGROUND OF THE INVENTION

The present invention relates to ballast broom (also called sweepers) for sweeping the ballast on railroad tracks. More specifically, the present invention relates to a ballast sweeper having a high degree of efficiency and an associated method.

The use of ballast sweepers in connection with maintenance of a railroad track is well known. Commonly, a plow or blade-like element is used to shape or distribute the ballast in a desired arrangement. However, when ballast is plowed or new ballast is dumped onto a railway roadbed, ballast may become disposed upon the tops of the railroad ties.

In order to evenly distribute the ballast and in order to clear ballast from the tops of the railroad ties, it is common to use a railroad maintenance machine having a rotary sweeping core with a plurality of sweeper elements or bristles such as disclosed in the present inventor's prior U.S. Pat. No. RE. 31,619 issued Jul. 3, 1984 and hereby incorporated by reference. That patent describes a particular sweeper element (also called broom element or bristle) and a method of making it. The rotary core may be mounted on the same machine as the plow blade.

The present inventor's prior U.S. Pat. No. 5,394,586 issued Mar. 7, 1995 and hereby incorporated by reference discloses a dust control arrangement and technique for such rotary core ballast sweepers.

With reference to the simplified side view schematic of FIG. 1, the common prior art technique for ballast sweeping is shown. The sweeper or broom vehicle 10 has a housing 12 and rotary core 14 with 6 rows (only some shown for ease of illustration) of broom elements 16. As the core 12 rotates counterclockwise in the view of FIG. 1 and the vehicle 10 moves rightwardly, ballast 16B is thrown by the elements 16 at a series of deflectors 18 (only one shown). The deflectors 18 cause the ballast to bounce off them and move transversely to the rail direction (rail direction is left to right in FIG. 1, whereas ballast bounces out or into the plane of view of FIG. 1). The ballast is thus moved from being on top of ties to being off the end of ties.

Although the deflector arrangement has been used over the years, it is subject to numerous disadvantages. Specifically, it requires one to go over a given section of road bed numerous times in order to remove a satisfactory portion of the ballast from the tops of the ties. Each time the machine goes over a section of road bed, it moves the ballast on tops of ties, but several passes are required to sufficiently clean the ties. The ballast may not bounce quite right and thus may be moved little or no amount in the proper direction.

The core 14 must rotate sufficiently fast that most ballast 16B will have sufficient momentum to bounce off the inclined deflector plates an adequate distance. If the core 14 rotates too slowly, the ballast won't bounce far enough. On the other hand, the high speed of rotation (for example 220 to 250 revolutions per minute) means that some ballast gets carried over the top of the core 14 and may remain on the tops of ties. (This so-called material carry over is one of the reasons that material disposal or movement is not as efficient as desirable such that multiple passes are required.)

The high speed of rotation also generates substantial noise and dust. Various steps to deal with the dust and/or noise may thus be required.

OBJECTS AND SUMMARY OF THE INVENTION

Accordingly, it is a primary object of the present invention to provide a new and improved ballast broom and method.

A more specific object of the present invention is to provide highly efficient ballast sweeping.

A further object of the present invention is to provide ballast sweeping with reduced noise.

Yet another object of the present invention is to provide ballast sweeping with reduced dust.

A further object of the present invention is to provide ballast sweeping with a lower rotary core speed than previously.

Yet another object of the present invention is to provide ballast sweeping with less material carry over.

The above and other features of the present invention which will be more readily understood when the following detailed description is considered in conjunction with the accompanying drawings are realized by a railroad ballast broom vehicle having first and second sides and including: a vehicle frame having rail-engaging wheels; a broom supported by the vehicle frame and having a housing and a rotary core with broom elements fixed to rotate therewith about a broom axis; and an auger supported by the vehicle frame adjacent to the broom such that ballast is thrown from the broom to the auger, the auger being rotatable about an auger axis and being operable to carry ballast received from the broom to at least a first auger outlet on the first side of the vehicle. The auger is a double auger and is operable to carry ballast received from the broom to a second auger outlet on the second side of the vehicle in addition to carrying some ballast to the first auger outlet. The auger is movably mounted in an auger housing such that the auger will move away from ballast in the auger housing which might otherwise bind the auger to the auger housing. The auger is movably mounted in the auger housing such that the auger is movable upwardly relative to a portion of the auger housing below the auger. The auger is movably mounted in the auger housing by way of a ball and socket joint. Over a range, a clearance between an outer periphery of the auger and an upper surface of the auger housing increases in an auger rotation direction. The auger housing has a scroll portion.

The vehicle further includes: first and second motor plates respectively mounted to first and second side walls of the broom housing, each plate offset an offset distance from the corresponding side wall and fixed to the corresponding side wall at fix points; and first and second broom drive motors mounted respectively to the first and second motor plates; and wherein the first and second motor plates are flexible relative to the respective first and second side walls such that minor misalignments between the rotary core and the first and second broom drive motors will be accommodated with minimal stress-causing vibration or oscillation on the rotary core and the first and second side walls.

The vehicle of further includes a dust filter at least partially above the auger and operable to filter dust from air above the auger. A segmented skirt is disposed around a lower periphery portion of the broom housing. A blower is disposed to lower pressure within the broom housing and reduce escape of dust therefrom.

The present invention may alternately be described as a railroad ballast broom vehicle having first and second sides and including: a vehicle frame having rail-engaging wheels; a ballast pick up supported by the vehicle frame for picking up ballast from a railroad road bed; an auger supported by the vehicle frame adjacent to the ballast pick up for receiving ballast from the ballast pick up, the auger being rotatable about an auger axis and being operable to carry ballast received from the ballast pick up to at least a first auger outlet on the first side of the vehicle; and a dust filter at least partially above the auger and operable to filter dust from air above the auger. The auger is a double auger and is operable to carry ballast received from the broom to a second auger outlet on the second side of the vehicle in addition to carrying some ballast to the first auger outlet.

A ramp extends down from the auger housing such that ballast may pass up the ramp to enter the auger housing and wherein the auger is movably mounted in the auger housing by way of a ball and socket joint. The ballast pick up is a broom supported by the vehicle frame and having a housing and a rotary core with broom elements fixed to rotate therewith about a broom axis extending generally parallel to the auger axis.

The present invention may alternately be described as a railroad ballast broom vehicle having first and second sides and including: a vehicle frame having rail-engaging wheels; a broom supported by the vehicle frame and having a housing with first and second side walls and a rotary core with broom elements fixed to rotate therewith about a broom axis; first and second motor plates respectively mounted to the first and second side wall, each plate offset an offset distance from the corresponding side wall and fixed to the corresponding side wall at fix points; and first and second broom drive motors mounted respectively to the first and second motor plates; and wherein the first and second motor plates are flexible relative to the respective first and second side walls such that minor misalignments between the rotary core and the first and second broom drive motors will be accommodated with minimal stress-causing vibration or oscillation on the rotary core and the first and second side walls. Each of the first and second mount plates has a central portion and three outwardly extending legs having the fix points at ends of the legs. Each of the first and second broom drive motors has an axis of rotation in line with the broom axis (i.e., apart from minor or unintended misalignments) and each of the first and second broom drive motors is a hydraulic motor.

The present invention may alternately be described as a method of sweeping ballast on a railroad road bed, the steps including:

putting a railroad ballast broom vehicle upon a section of a track having road bed to be cleaned, the railroad ballast broom vehicle having first and second sides and including:

a vehicle frame having rail-engaging wheels;

a ballast pick up supported by the vehicle frame for picking up ballast from a railroad road bed; and an auger supported by the vehicle frame adjacent to the ballast pick up for receiving ballast from the ballast pick up, the auger being rotatable about an auger axis and being operable to carry ballast received from the ballast pick up to at least a first auger outlet on the first side of the vehicle;

operating the ballast pickup to pick up ballast from the road bed and provide the picked up ballast to the auger; and operating the auger to carry ballast received from the ballast pickup to at least the first auger outlet.

The ballast pick up is a broom supported by the vehicle frame and having a housing and a rotary core with broom elements fixed to rotate therewith about a broom axis. The step of operating the ballast pick up is performed by rotating the rotary core and broom elements. Only a single pass is made of the vehicle over a given section of road bed in need of sweeping.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 2:
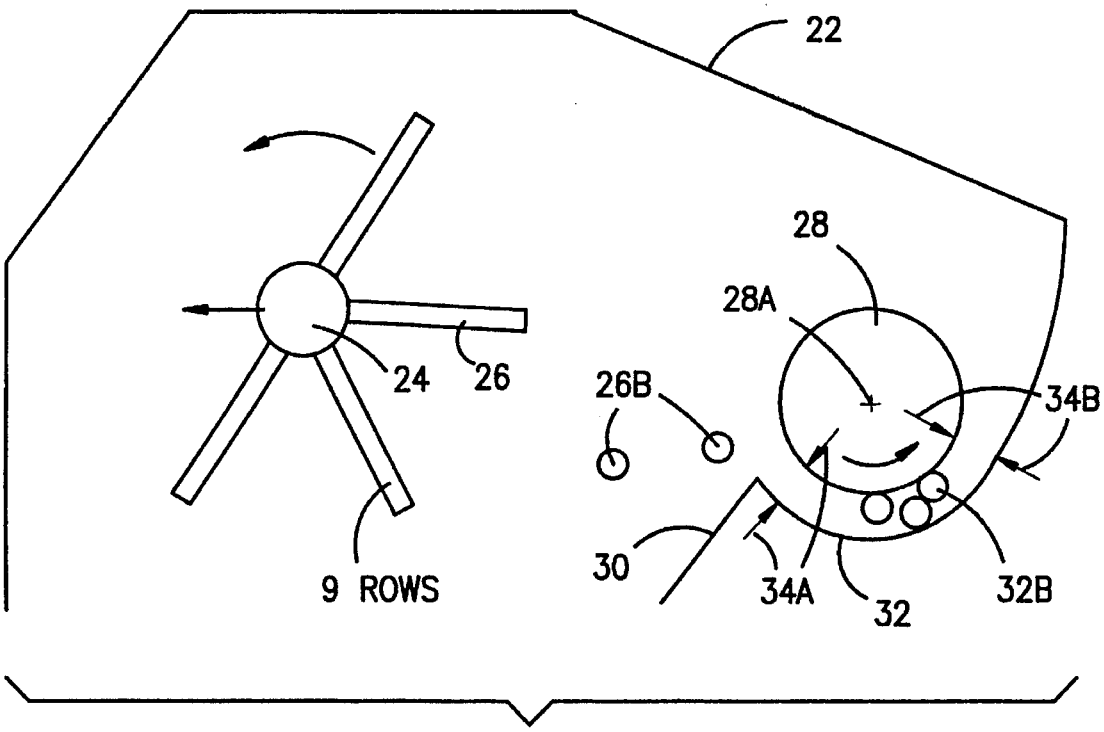
FIG. 2 is a simplified side view schematic of the present invention for illustrating its principle of operation.

Turning now to FIG. 2, the broom vehicle 20 of the present invention has a housing 22, rotary core 24, and broom elements 26. The broom elements 26 may be constructed as in the present inventor's above incorporated by reference reissue patent, whereas the core 24 is improved over the core 14.

Specifically, the core 24 has a diameter of 14 inches to provide a reel diameter (diameter of core 24 plus two times 18 inch elements 26 on opposite sides) of 50 inches. The core 14 of FIG. 1 for one known structure had a diameter of about 8 and ⅜ inches to provide a reel diameter of about 44 and ⅜ inches (8 and ⅜ inches plus two times the 18 inch length of the elements 16 on each side).

The larger diameter of the core 24 allows one to use 9 rows of the elements 26, instead of the 6 rows of elements 16 used with core 14. For ease of illustration, the rows are not shown in the FIGS. The elements 26 would be attached to the core 24 using known devices (not shown) and would be disposed at different angular and axial positions on the cylindrical core 24 such that each of the 9 rows may spirally wind at least partially around the axis of core 24 in known fashion. The importance of the larger number of rows is that the vehicle 20 of the present invention will be efficient enough to perform ballast sweeping on a single pass (without the machine sweeping over a given section of road bed multiple times). The larger number of rows of elements 26 and associated larger number of elements (possible because of the increased diameter core 24) help insure full sweeping of the tops of railroad ties on a single pass.

Figure 1:
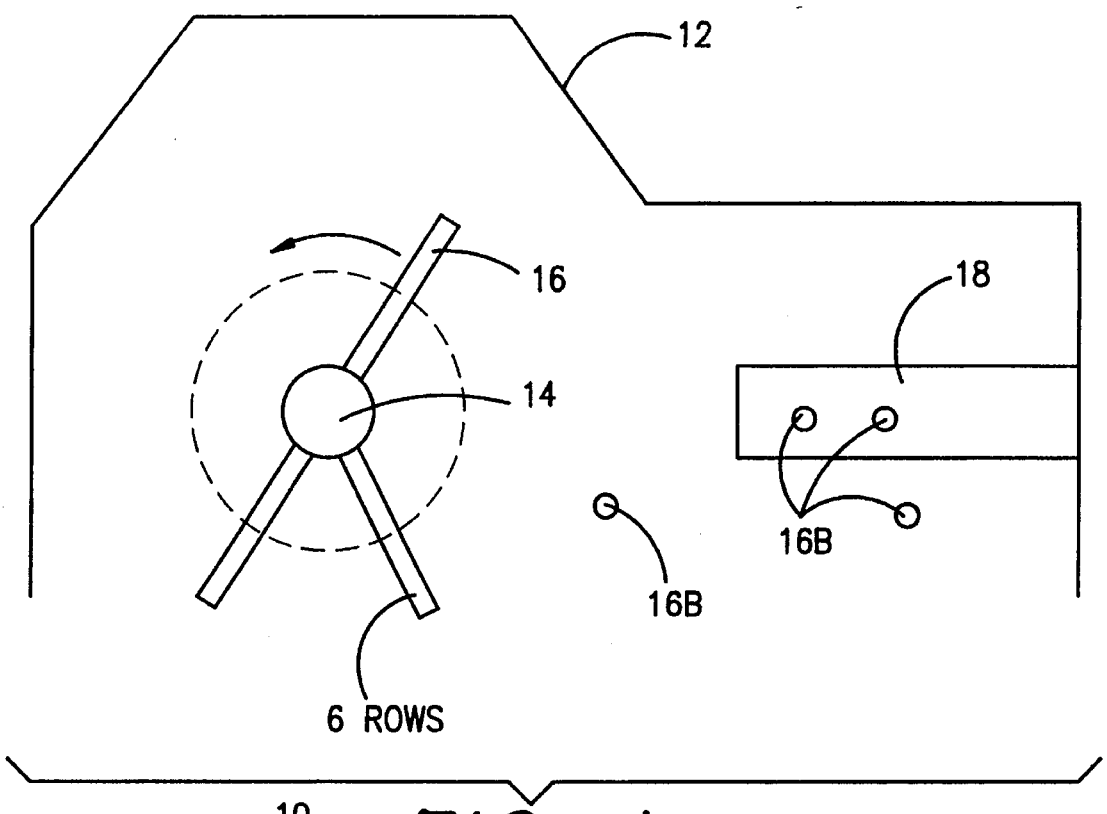
FIG. 1 (PRIOR ART)
FIG. 1 is a simplified side view schematic of a common prior art structure for ballast sweeping as discussed above.

A quite important feature of the present invention is that the deflector plates such as 18 of FIG. 1 are not used. Instead, an auger 28 is used which rotates about auger axis 28A. Ballast 26B thrown or moved by elements 26 are given sufficient momentum to go above the top of a ramp 30, either by being thrown higher than the top of the ramp or, if thrown below the ramp top, bouncing up the ramp.

Since getting the ballast over the top of ramp 30 into a scroll case 32 for auger 28 takes much less momentum than required for the deflector plate arrangement of FIG. 1, the core 24 is preferably rotated at under 150 revolutions per minute, more preferably at 80 to 120 revolutions per minute, most preferably about 100 revolutions per minute. This lowers the noise and dust as compared to the noise and dust associated with the higher rotary speed of prior art core 14.

The auger 28 is horizontal and perpendicular to the direction of the rails (rails not shown) on which the vehicle 20 would be moving rightwardly in FIG. 2. Ballast 32B received in scroll housing 32 is moved out the ends of the housing 32 onto the sides of the track, where plows (not shown) on the vehicle 20 would reshape it at the shoulders of the road bed in known fashion.

The housing 32, which may more generally be known as an auger housing, is preferably a scroll housing in the sense of having a spiral upper surface such that the clearance between the outer periphery of auger 28 and the upper surface of housing 32 over a range such as from 34A to 34B increases monotonically as a spiral curve. This greatly reduces the chances that material will jam the auger 28.

Figure 3:
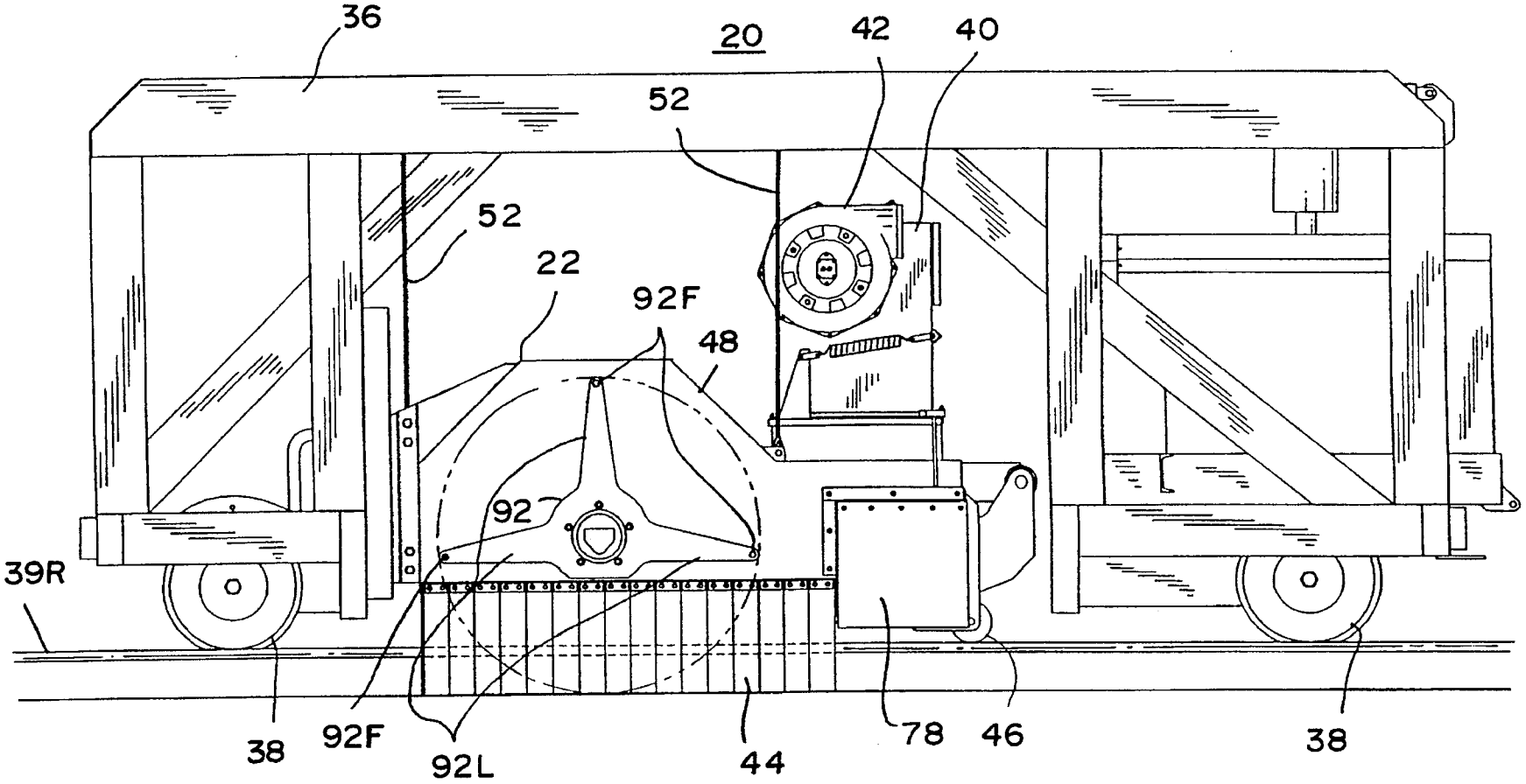
FIG. 3 is a side view of a vehicle according to the present invention with a broom assembly in a lower or operation position.

With reference now to FIG. 3, a side view of the vehicle 20 is used to show many components of the present invention. For ease of illustration, the ballast plows, operator seat, diesel or other power plant engine for propelling the vehicle, and various hydraulic components used for propulsion and powering other parts of the vehicle are not shown as they may be constructed in accord with generally known principles.

Vehicle 20 has a main frame 36 and four (only two visible) rail engagement wheels 38 which may engage rails such as right rail 39R. A housing upper portion 40 (which may alternately be referred to as a dust filter housing or dust control housing) and a blower 42 are constructed and operable in essentially identical fashion as respective components 16U and 24 of the incorporated by reference U.S. Pat. No. 5,394,586 patent. Without getting into details presented in the '586 patent, the upper portion 40 houses a series of air filters which are used to control dust from the sweeping operation. Dust generated from the sweeping operation within housing 22 is also largely contained by a skirt arrangement 44 having two skirts of staggered segments of rubber or similar material in the manner described in the '586 patent.

Figure 4:
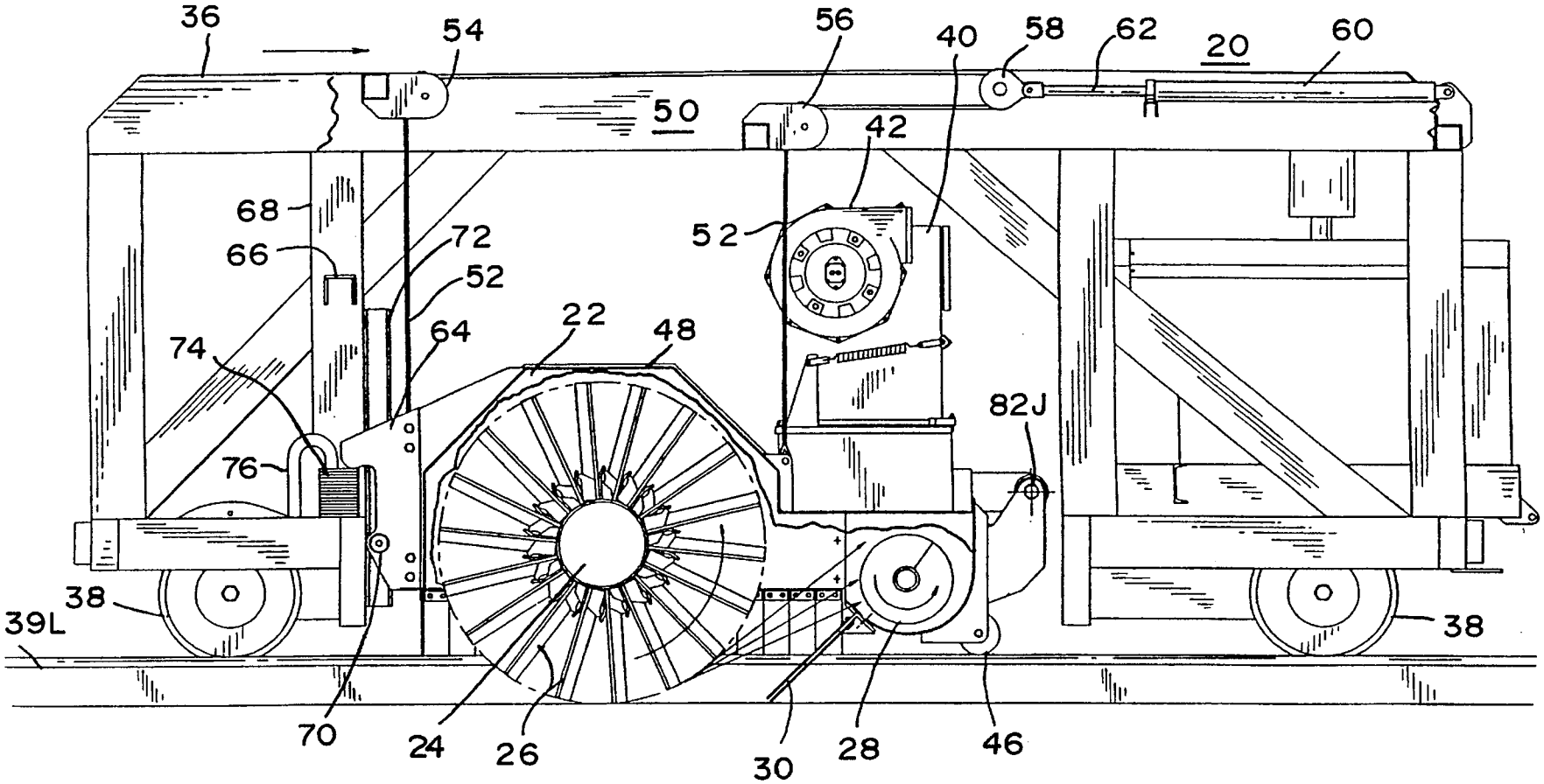
FIG. 4 is a side view of the vehicle of FIG. 3 with its broom assembly in a lower or operation position as in FIG. 3, but with some parts broken away to show other parts.
Figure 5:
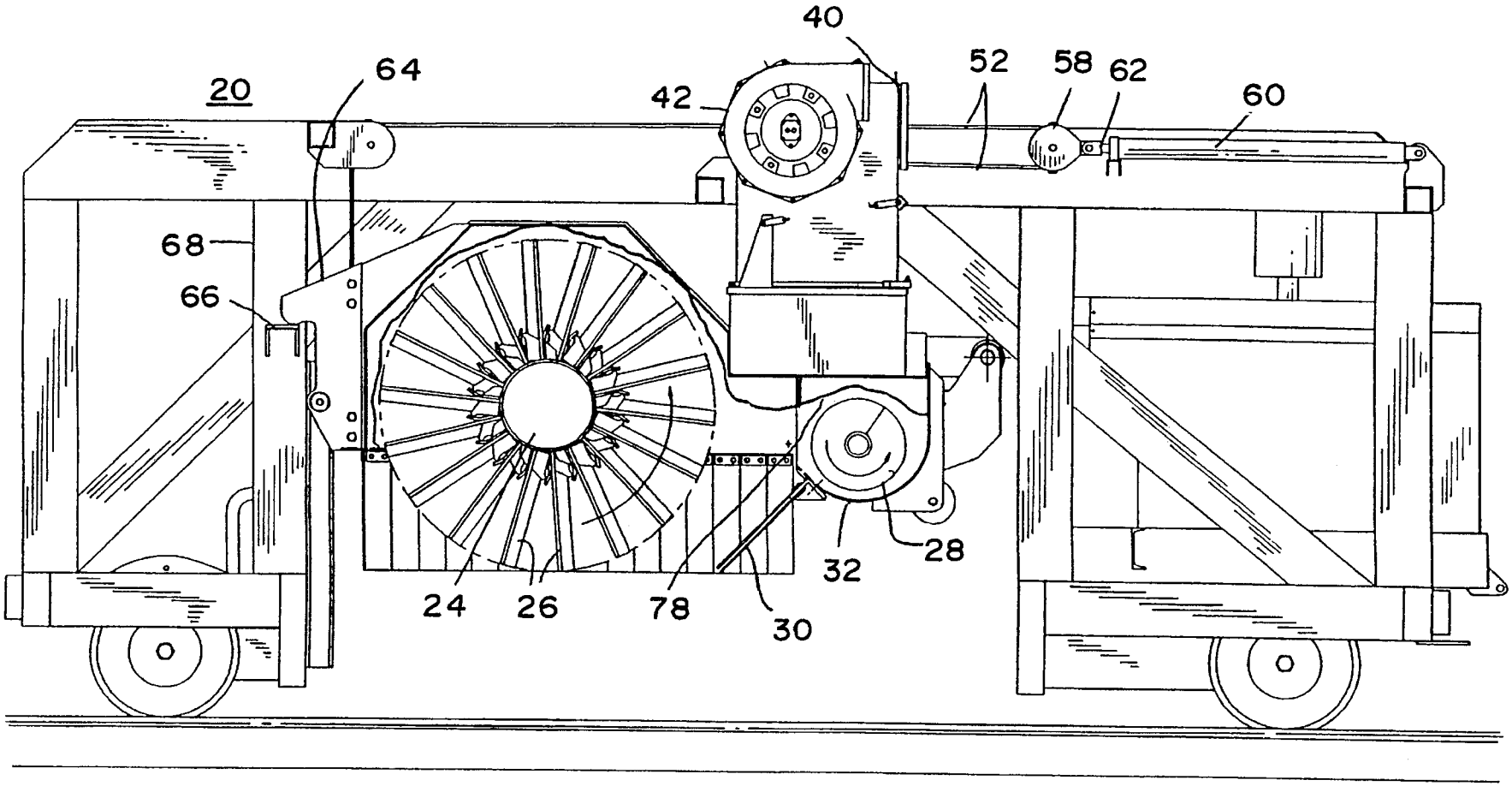
FIG. 5 is a side view of the vehicle of FIG. 3 with its broom assembly in an upper or travel position and with some parts broken away to show other parts.

Continuing to view FIG. 3, but also considering FIGS. 4 and 5, the housing 22 is integral with or welded or otherwise fixed to scroll housing 32. The ramp 30 is made of rubber or similar material bolted to housing 32 by way of a bracket. The ramp 30 extends perpendicularly to the rail direction corresponding to right and left rails 39R and 39L. Specifically, the ramp 30, which may be segmented as with the skirts 44, extends from the right rail 39R of FIG. 3 to the left rail 39L of FIG. 4 (right rail 39R is not shown in FIG. 4 to better illustrate other components).

The auger 28 and its associated ramp 30 and scroll housing 32 are supported at the proper clearance from the rails (and generally at the proper height) by right and left rollers such as illustrated roller 46. It will be understood that there would be one roller or other rotatable rail engagement device for each rail or possibly for both rails.

The housing 22, core 24, broom or sweeper elements 26, auger 28, ramp 30, scroll housing 32, dust control housing 40, blower 42, skirts 44, rollers 46, and various associated components may collectively be considered as a broom assembly 48. The broom assembly is movably mounted to rail direction extending beams 50 of the main frame 36 by cables 52 fixed at front and back points on assembly 48 and extending through pulleys 54 and 56 (fixed to one of beams 50) and pulley 58 movably mounted at the rod end of cylinder 60. Only one of the beams 50, cables 52, cylinders 60, and one each of pulleys 54, 56, and 58 are shown, but it will be readily understood that identical right and left structures would preferably be used corresponding to right and left sides of the assembly 48. Each of the lift cylinders 60 is mounted to a corresponding right or left side beam 50.

When the cylinders 60 retract, pulleys 58 move rightwardly from their FIG. 4 position to their FIG. 5 position, this corresponding to frontwardly relative to vehicle 20. The movement of right and left pulleys such as 58 as rod ends 62 of cylinders 60 retract causes lifting of the back end of assembly 48 (left in FIGS. 3–5) first due to pulley 58. When the assembly 48 has been lifted sufficiently high and tilted (effectively rotated clockwise relative to the direction of view of FIGS. 3–5), continued retraction then lifts the front end (right in FIGS. 3–5) of assembly 48 by the front parts of cables 52 (right and left cables, but only one visible). This causes the assembly 48 to tilt back (effectively rotate counterclockwise relative to the direction of view of FIGS. 3–5) until the upper end of a rearwardly extending lock plate 64 projects over and seats on a mount 66 on vertical beam 68 as shown in FIG. 5. As the rear or back of assembly 22 was lifted initially, a wheel or cam follower 70 rides up a vertical channel or slot 72. Although not shown, one or more latches, safety pins, or other mechanisms may be used in known fashion to secure the assembly 48 in its FIG. 5 travel position with the upper hook like part of plate 64 on support 66.

When the assembly 48 is to be used for sweeping, it is moved from its upper or travel position of FIG. 5 to its lower, operating, or sweeping position of FIG. 4. Specifically, rod end 62 is extended initially causing assembly 48 to tilt forward (rotate clockwise in these FIGS.) as its front end is lowered by action of cable 52 and pulley 58 until 64 is free of (forward of) the support 66. Continued extension of the rod end 62 causes the back end of assembly 48 to lower with wheel 70 riding down channel 72 until the upper part of plate 64 seats on shims 74 captured to shim mount rod 76. The shims 74 may be used to set the back of assembly 48 at the proper height, thus setting correct broom depth.

As with numerous of the components described above including components numbered 46 and 50 to 62, only one of each of the components 64 to 76 are shown, but there preferably would be identical right and left side components 64 to 76. It will be readily appreciated that the vehicle 20 has essentially symmetric construction about a central axis of symmetry running in the lengthwise direction (i.e., rail direction) centrally located between right and left rails 39R and 39L.

Figures 6, 7, 8, 9:
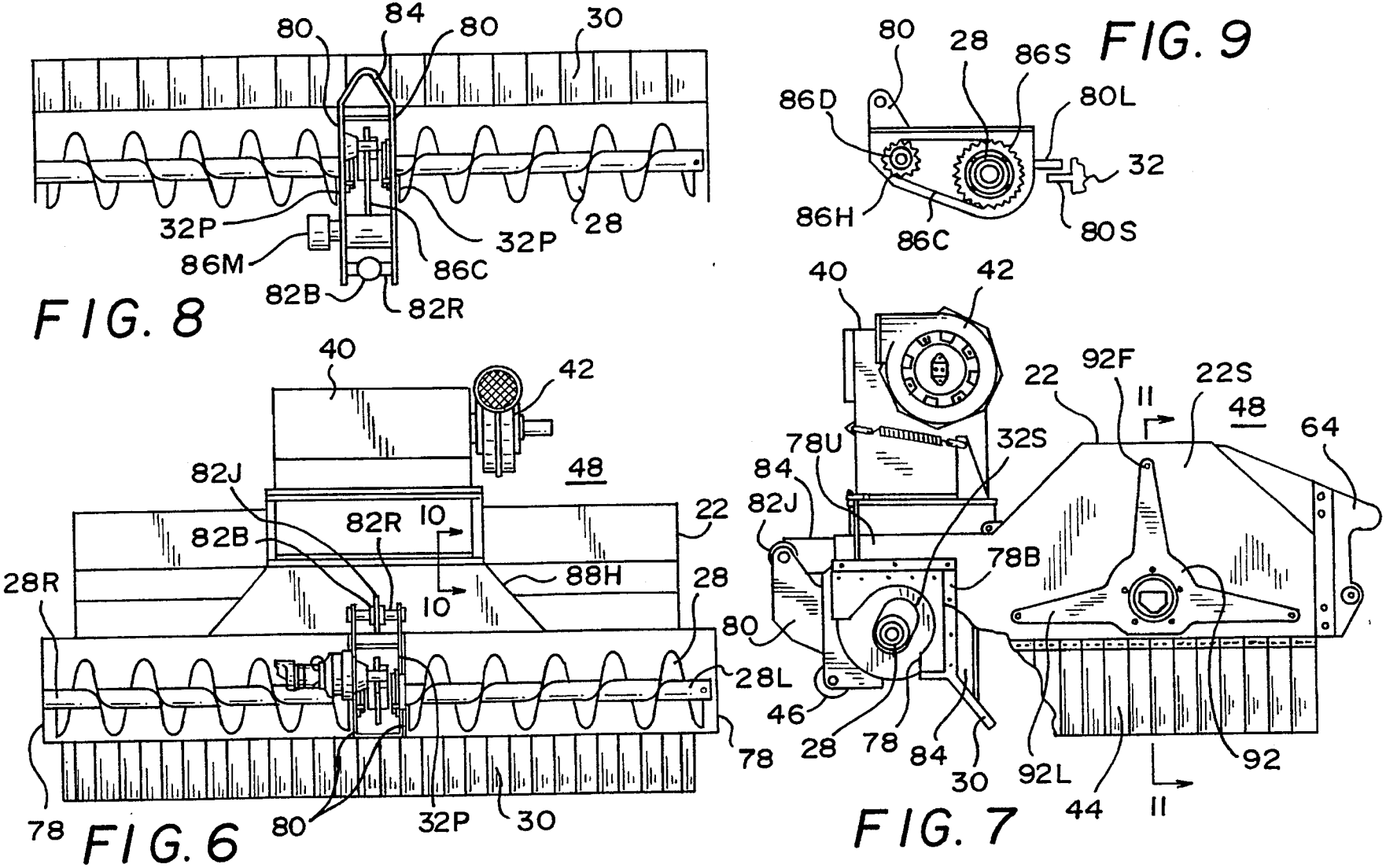
FIG. 6 is a front view of parts of the broom assembly with some parts broken away.
FIG. 7 is a side view of parts of the broom assembly with some parts broken away.
FIG. 8 is a top view of parts of the broom assembly with some parts broken away.
FIG. 9 is a side view of some parts of the broom assembly.

Turning now primarily to FIGS. 6 and 7, the auger 28 is a double auger such that ballast swept to the right side of the auger is moved rightwardly out end 28R (left side in the rearward looking view of FIG. 6) and ballast swept to the left side of the auger 28 is moved leftwardly out end 28L. Each of the identical ends of the generally semi-cylindrical (more precisely scroll) auger housing 32 is open except for a rubber or other flexible material flap 78 (partially cut away in FIG. 7) bolted or otherwise attached to housing 32 at flap upper edge 78U and flap back edge 78B. The flaps 78 may extend down to the lowest point of the housing 32 (as shown in FIG. 3). Alternately, and unshown, the flaps 78 may extend as down as far as the bottom of the skirts 44. Further, the flaps may wrap around the ends of the housing 32 and extend some distance in a transverse direction (perpendicular to the rail direction). In any case, the flaps 78 tend to limit or contain any dust which is generated when ballast materials are augured out of the opposite ends of housing 32.

With reference now to FIGS. 6–9, the auger 28 is rotatably mounted to two parallel auger mount plates 80. The mount plates 80 have a rod 82R extending between them with a ball joint 82J in the middle for allowing mount plates 80 and associated auger 28 some movement relative to a socket member 84 having a socket therein (not separately labeled) and in which the ball 82J would be captured. In that fashion, plates 80 and auger 28 may together move relative to socket member 84, which member 84 is fixed to the scroll or auger housing 32. Thus, the auger may pivot counterclockwise about an axis normal to the plane of view of FIG. 7 and running through ball joint 82J to provide further protection (i.e., beyond the scroll shape of housing 32) against ballast wedging between auger 28 and housing 32. In the event that ballast starts to bind between the auger 28 and housing 32, the ball joint 82J allows the auger 28 to float up from the housing 32 until the ballast is moved out of any binding position.

In addition to the floating up of the auger 28 relative to housing 32, which degree of freedom corresponds to the auger pivoting just discussed, the ball joint 82J provides a second and third degree of freedom for the auger 28 relative to housing 32. Specifically, and with reference now to FIG. 6, the ball joint 82J allows pivoting of plates 80 and auger 28 about a vertical axis running through joint 82J and about a horizontal axis running through joint 82J. The three degrees of freedom of the auger 28 relative to housing 32 greatly minimize the risk of ballast jamming the auger 28.

As partially shown in FIG. 7 and best shown in the top view of FIG. 8, ballast cannot enter the space between plates 80 due to the rubber shield 84 which tends to deflect any ballast to the side for transport by the auger 28. Unlike the prior design discussed above which uses deflectors to move central ballast across half of the rail gauge in each direction, the shield 84 simply blocks ballast from a relatively small central part of auger 28. Within that central part between plates 80, a chain drive housing 86H has a chain drive 86C to rotate auger 28 by the operation of hydraulic motor 86M rotating drive sprocket 86D and, via chain 86C, driven sprocket 86S. The driven sprocket 86S is centrally fixed to the auger 28 to cause rotation of the auger 28, preferably at about 50 revolutions per minute. If desired, the scroll housing 32 may be a split housing with right and left halves having separate inner plates 32P with heavy rubber shield 84 therebetween. Slots 32S (see FIG. 7) are disposed in plates 32P such that auger 28 can move with the degrees of freedom (within the limits of slots 32S) discussed above.

Figure 10:
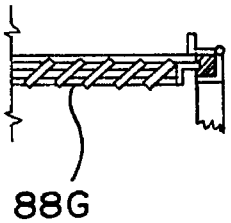
FIG. 10 is a cross section view taken along lines 10—10 of FIG. 6.

With reference to FIGS. 6 and 10, an upwardly narrowing collection hood 88H pulls air within assembly 48 (i.e., within housings 22 and 32) towards grate 88G (FIG. 10), which grate separates dust from the air in a similar fashion to that described relative to grate 38 of the incorporated by reference '586 patent. Air pulled above grate 88G would be filtered in the fashion described in that '586 patent. However, by having the dust control unit (corresponding to housing 40) above an auger 28 (refer to FIG. 4) instead of above a broom (as in FIG. 2 of the '586 patent), less dust gets into the filters. Further, the slower speed of core 24 (as compared to the speed used in the '586 patent), generates less dust and noise. There is less material carry over of the broom 24 because the dust which falls when the filters are backwashed (backwashing technique described in '586 patent) falls into the scroll or auger housing 32, not into the broom as in the '586 patent. The blower 42 will provide the advantageous negative pressure within housing 22 to reduce dust as described in the '586 patent. The present invention provides more efficient material disposal than the '586 patent such that a single pass of vehicle 20 is sufficient to adequately clean a road bed.

With reference to FIG. 9, the plates 80 (one partially shown only) has a limit projection 80L limiting downward movement of the auger 28 (not in FIG. 9) by contacting stop 80S fixed to scroll housing 32. Thus, the auger 28 will always be a certain minimum distance above the housing 32.

With reference now to FIGS. 3, 4, 7, and 11, the cylindrical rotary core 24 of the broom is powered by opposite end hydraulic motors 90. The motors 90 and core 24 have a common axis of rotation 90A, meaning that, within manufacturing tolerances, they are aligned. Each of the motors has an axis of rotation generally in line (i.e., apart from minor or undesired misalignments) with the broom axis. However, minor misalignments could cause stress-inducing vibration or oscillation which eventually might wear out some components. To avoid or greatly reduce that risk, the motors 90 are mounted to motor mount plates 92, instead of directly to the side walls 22S of housing 22. The mount plates 92, which will also be called flex plates, are made of steel or other metal and have sufficient flexibility relative to the side walls 22S such that minor misalignments between the rotary core and the broom drive motors will be accommodated with minimal stress-causing vibration or oscillation on the rotary core and the first and second side walls. As best shown in FIGS. 3 and 7, the mount or flex plates 92 have a central portion and three outwardly extending legs 92L having one fix point 92F at ends of each of the legs. At the fix points 92F, the plates are fixed (bolted or otherwise attached) to the corresponding side wall 22 with an offset (i.e., between gauge side of plate 92 and field surface of side wall 22S) about ¼ inch. Spacers in FIG. 11, such as small welded plates, on side walls 22S may be used to provide the offset. By overcoming the problem of slight misalignments, the present invention allows use of a simpler direct connection between shafts of the motors 90 and the core 24, instead of using a chain drive for the core as in previous designs. As with other places where dust might escape from the housing 22, the offsets between side walls 22S and plates 92 would be sealed with rubber (not shown) or similar flexible material which will allow the flexing of plates 92, but block passage of dust.

Figure 12:
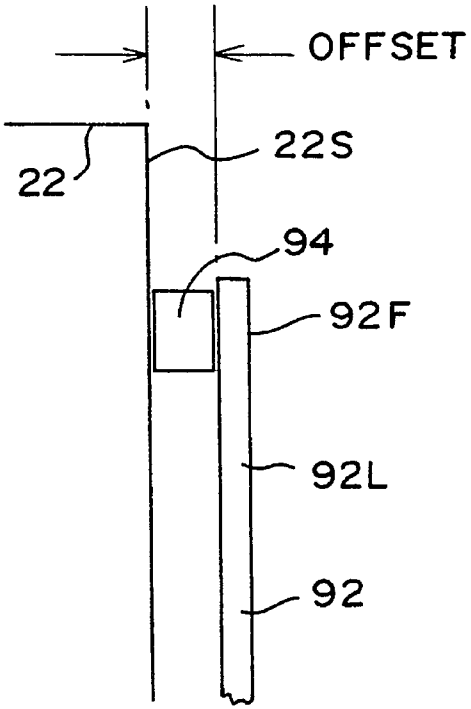
FIG. 12 is a simplified, enlarged side view of some portions of a housing and flex plate and related components from FIG. 11.
Figure 11:
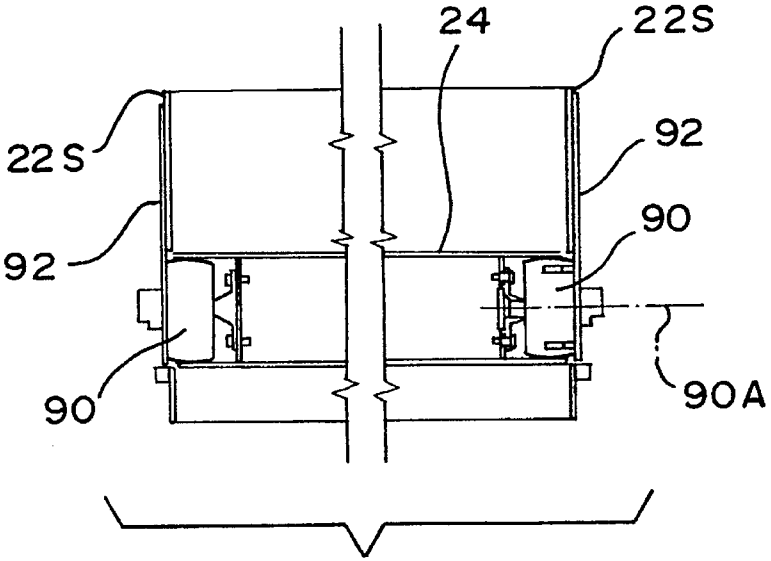
FIG. 11 is a cross section view taken along lines 11—11 of FIG. 7.

The enlarged side view of FIG. 12 shows how a spacer 94 on side wall 22S of housing 22 provides the illustrated offset between the gauge side of plate 92 and the field surface of side wall 22S. Specifically, and as previously mentioned, the spacer 94 provides the offset at fix point 92F of the leg 92L of flex plate 92.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A railroad ballast broom vehicle comprising:

first and second sides of the vehicle;

a vehicle frame having rail-engaging wheels;

a broom supported by the vehicle frame and having a housing and a rotary core with broom elements fixed to rotate therewith about a broom axis;

an auger supported by the vehicle frame adjacent to the broom such that ballast is thrown from the broom to the auger, the auger having at least a first auger outlet on the first side of the vehicle, the auger being rotatable in an auger rotation direction about an auger axis and being operable to carry ballast received from the broom to at least the first auger outlet;

an auger housing; and a ball and socket joint; and wherein the auger is movably mounted in the auger housing by way of the ball and socket joint.

2. The railroad ballast broom vehicle of claim 1 further comprising a second auger outlet, the second auger outlet being on the second side of the vehicle; and wherein the auger is a double auger and is operable to carry ballast received from the broom to the second auger outlet in addition to carrying some ballast to the first auger outlet.

3. The railroad ballast broom vehicle of claim 1 further comprising an auger housing and wherein, over a range in the auger rotation direction, a clearance between an outer periphery of the auger and an upper surface of the auger housing increases.

4. The railroad ballast broom vehicle of claim 1 further comprising an auger housing having a scroll portion.

5. The railroad ballast broom vehicle of claim 1 wherein the auger is movably mounted in the auger housing such that the auger will move away from ballast in the auger housing which might otherwise bind the auger to the auger housing.

6. The railroad ballast broom vehicle of claim 1 wherein the auger is movably mounted in the auger housing such that the auger is movable upwardly relative to a portion of the auger housing below the auger.

7. The railroad ballast broom vehicle of claim 1 further comprising a dust filter at least partially above the auger and operable to filter dust from air above the auger.

8. A railroad ballast broom vehicle comprising:

first and second sides of the vehicle;

a vehicle frame having rail-engaging wheels;

a broom supported by the vehicle frame and having a housing and a rotary core with broom elements fixed to rotate therewith about a broom axis; and an auger supported by the vehicle frame adjacent to the broom such that ballast is thrown from the broom to the auger, the auger having at least a first auger outlet on the first side of the vehicle, the auger being rotatable about an auger axis and being operable to carry ballast received from the broom to at least the first auger outlet;

first and second motor plates respectively mounted to first and second side walls of the broom housing, each plate offset an offset distance from the corresponding side wall and fixed to the corresponding side wall at fix points; and first and second broom drive motors mounted respectively to the first and second motor plates; and wherein the first and second motor plates are flexible relative to the respective first and second side walls such that minor misalignments between the rotary core and the first and second broom drive motors will be accommodated with minimal stress-causing vibration or oscillation on the rotary core and the first and second side walls.

9. The railroad ballast broom vehicle of claim 8 further comprising an auger housing and wherein the auger is movably mounted in the auger housing such that the auger will move away from ballast in the auger housing which might otherwise bind the auger to the auger housing.

10. The railroad ballast broom vehicle of claim 8 further comprising an auger housing and wherein the auger is movably mounted in the auger housing such that the auger is movable upwardly relative to a portion of the auger housing below the auger.

11. The railroad ballast broom vehicle of claim 8 further comprising a dust filter at least partially above the auger and operable to filter dust from air above the auger.

12. The railroad ballast broom vehicle of claim 11 further comprising a segmented skirt around a lower periphery portion of the broom housing, and a blower disposed to lower pressure within the broom housing and reduce escape of dust therefrom.

13. A railroad ballast broom vehicle comprising:

first and second sides of the vehicle;

a vehicle frame having rail-engaging wheels;

a ballast pick up supported by the vehicle frame for picking up ballast from a railroad road bed;

an auger supported by the vehicle frame adjacent to the ballast pick up for receiving ballast from the ballast pick up, the auger having at least a first auger outlet on the first side of the vehicle, the auger being rotatable about an auger axis and being operable to carry ballast received from the ballast pick up to at least the first auger outlet; and a dust filter at least partially above the auger and operable to filter dust from air above the auger; and wherein the auger further has a second auger outlet, the second auger outlet being on the second side of the vehicle; and wherein the auger is a double auger and is operable to carry ballast received from the broom to the second auger outlet in addition to carrying some ballast to the first auger outlet.

14. The railroad ballast broom vehicle of claim 13 further comprising an auger housing and wherein the auger is movably mounted in the auger housing such that the auger will move away from ballast in the auger housing which might otherwise bind the auger to the auger housing.

15. The railroad ballast broom vehicle of claim 14 further comprising a ramp extending down from the auger housing and up which ballast may pass to enter the auger housing and wherein the auger is movably mounted in the auger housing by way of a ball and socket joint.

16. The railroad ballast broom vehicle of claim 15 wherein the ballast pick up is a broom supported by the vehicle frame and having a housing and a rotary core with broom elements fixed to rotate therewith about a broom axis extending generally parallel to the auger axis.

17. A railroad ballast broom vehicle having first and second sides and comprising:

a vehicle frame having rail-engaging wheels;

a broom supported by the vehicle frame and having a housing with first and second side walls and a rotary core with broom elements fixed to rotate therewith about a broom axis;

first and second motor plates respectively mounted to the first and second side wall, each plate offset an offset distance from the corresponding side wall and fixed to the corresponding side wall at fix points; and first and second broom drive motors mounted respectively to the first and second motor plates; and wherein the first and second motor plates are flexible relative to the respective first and second side walls such that minor misalignments between the rotary core and the first and second broom drive motors will be accommodated with minimal stress-causing vibration or oscillation on the rotary core and the first and second side walls.

18. The railroad ballast broom vehicle of claim 17 wherein each of the first and second mount plates has a central portion and three outwardly extending legs having the fix points at ends of the legs.

19. The railroad ballast broom vehicle of claim 17 wherein each of the first and second broom drive motors has an axis of rotation in line with the broom axis and each of the first and second broom drive motors is a hydraulic motor.

20. The railroad ballast broom vehicle of claim 19 further comprising:

an auger supported by the vehicle frame adjacent to the broom such that ballast is thrown from the broom to the auger, the auger being rotatable about an auger axis and being operable to carry ballast received from the broom to at least a first auger outlet on the first side of the vehicle; and a dust filter at least partially above the auger and operable to filter dust from air above the auger.

* * * * *